US007315440B1

(12) United States Patent
Guo

(10) Patent No.: US 7,315,440 B1
(45) Date of Patent: Jan. 1, 2008

(54) CIRCUIT AND METHOD FOR DRIVING A COIL-ARMATURE DEVICE

(75) Inventor: Sam Yonghong Guo, Canton, MI (US)

(73) Assignee: Yazaki North America, Inc., Canton, MI (US)

( * ) Notice: Subject to any disclaimer, the term of this patent is extended or adjusted under 35 U.S.C. 154(b) by 359 days.

(21) Appl. No.: 10/731,560

(22) Filed: Dec. 9, 2003

(51) Int. Cl.
*H01H 47/32* (2006.01)

(52) U.S. Cl. ..... 361/154

(58) Field of Classification Search ..... 361/154
See application file for complete search history.

(56) References Cited

U.S. PATENT DOCUMENTS

| | | | | |
|---|---|---|---|---|
| 4,661,766 | A | 4/1987 | Hoffman et al. | 323/287 |
| 4,765,426 | A * | 8/1988 | Shimizu | 180/446 |
| 4,878,147 | A | 10/1989 | Oyama et al. | 361/154 |
| 4,925,156 | A * | 5/1990 | Stoll et al. | 251/129.01 |
| 4,949,215 | A | 8/1990 | Studtmann et al. | 361/154 |
| 4,953,056 | A | 8/1990 | Yakuwa et al. | 361/154 |
| 4,978,865 | A | 12/1990 | Hartmann et al. | 307/140 |
| 5,510,951 | A * | 4/1996 | Briedis et al. | 361/154 |
| 5,546,268 | A | 8/1996 | Hurley et al. | 361/154 |
| 5,687,050 | A * | 11/1997 | Bartsch | 361/154 |
| 5,910,890 | A * | 6/1999 | Hansen et al. | 363/41 |
| 5,986,896 | A | 11/1999 | Gibart et al. | 363/16 |
| 6,019,461 | A * | 2/2000 | Yoshimura et al. | 347/86 |
| 6,256,185 | B1 | 7/2001 | Maller | 361/152 |

FOREIGN PATENT DOCUMENTS

JP 58005438 A * 1/1983

* cited by examiner

*Primary Examiner*—Michael Sherry
*Assistant Examiner*—Scott Bauer
(74) *Attorney, Agent, or Firm*—Rader, Fishman & Grauer PLLC

(57) ABSTRACT

Methods and circuits for driving a coil-armature device are disclosed. The circuits are configured to drive the coil-armature device to a first energy level for a period of time sufficient to retract the armature to the center of the coil, and then, to drive the coil-armature device to a second energy level subsequently. The first energy level is greater than the second energy level. The second energy level may be achieved by alternatively connecting and disconnecting a driving voltage to the coil-armature device according to a "hold" mode duty cycle. The first energy level may be achieved by connecting the driving voltage to the coil-armature device continuously for a period of time sufficient to retract the armature to the center of the coil. Alternatively, the first energy level may be achieved by alternatively connecting and disconnecting the driving voltage to the coil-armature device according to a "pull-in" mode duty cycle, which is different from the "hold" mode duty cycle.

15 Claims, 2 Drawing Sheets

CIRCUIT AND METHOD FOR DRIVING A COIL-ARMATURE DEVICE

FIELD OF THE INVENTION

The present invention relates to coil-armature devices and, more specifically, to a circuit and method for driving a coil-armature device in an energy efficient manner.

BACKGROUND OF THE INVENTION

One common type of electromechanical switch used in a variety of different fields of technology includes the basic coil-armature device, such as, for example, a solenoid. The basic coil-armature device traditionally comprises a coil of wire, usually fashioned in cylindrical form, around some form of moveable core or armature. The introduction of an electric current through the coil of wire generates an electromagnetic field, which, in turn, attracts the moveable core, drawing it into the center of the coil. The movement of the armature is typically designed to interface a variety of different types of systems, such as, for example, an electrical contact or a valve.

Traditionally, a coil-armature device is activated by introducing a large initial current through the coil, thereby generating an electromagnetic field with sufficient strength to overcome system frictions and loads in order to rapidly attract the armature into the center of the coil. Once the armature is attracted to or retracted into the coil, the coil-generated electromagnetic field is maintained in order to hold the armature in place. However, the amount of power necessary to hold the armature in place after it has been retracted into the coil is but a fraction of the original amount of power necessary to draw the armature into the coil.

Typical coil-driving circuits apply a high level of current to the coil in order to initiate retraction of the armature. However, once the armature is retracted, these typical driving circuits continue to supply a high level of current to the coil to hold the armature in place. This use of excessive current to hold the armature in place not only results in a significant waste of energy, but also significant costs associated with the design and construction of a coil-armature device that is capable of handling high levels of current for an extended duration of time, as well as the buildup of heat associated with the high current levels.

The embodiments described hereinafter were developed in light of these and other problems identified by the inventors.

SUMMARY

Methods and circuits for driving a coil-armature device are disclosed. The circuits are configured to drive the coil-armature device to a first energy level for a period of time sufficient to retract the armature to the center of the coil, and then, to drive the coil-armature device to a second energy level subsequently. The first energy level is greater than the second energy level. The second energy level may be achieved by alternatively connecting and disconnecting a driving voltage to the coil-armature device according to a "hold" mode duty cycle. The first energy level may be achieved by connecting the driving voltage to the coil-armature device continuously for a period of time sufficient to retract the armature to the center of the coil. Alternatively, the first energy level may be achieved by alternatively connecting and disconnecting the driving voltage to the coil-armature device according to a "pull-in" mode duty cycle, which is different from the "hold" mode duty cycle.

DETAILED DESCRIPTION

Figure 1:
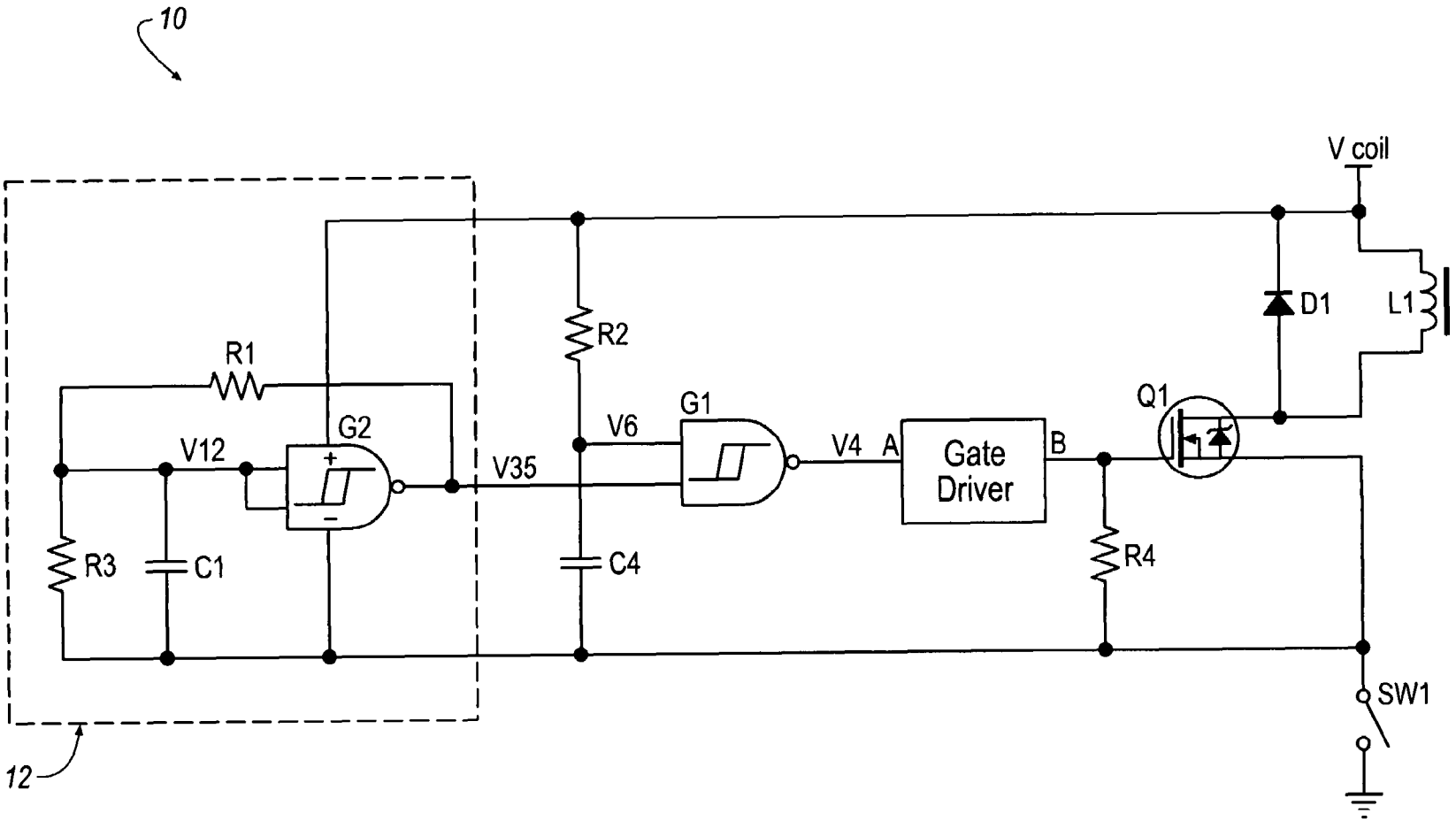
FIG. 1 is a circuit diagram of a coil driving circuit according to one embodiment of the present invention.

The present invention provides for a circuit that drives a coil with a large initial current during the "pull in" mode, where the armature is retracted, or pulled back, into the coil. The coil is then driven at a reduced current level during the "hold" mode, where the position of the armature is maintained or held in place. Beyond the obvious savings due to the use of less energy, the reduction in the average amount of power handled by the coil allows for the use of a smaller coil, which, in turn, allows for the overall size of the device to be reduced. Additionally, a reduction in the average amount of power handled by the coil-armature device also leads to a reduction in the amount of heat generated by the device.

A first exemplary embodiment of the invention will now be discussed with reference to the circuit diagram illustrated in FIG. 1. According to FIG. 1, coil driving circuit 10 connects to power supply $V_{coil}$, as well as to ground through a first switch SW1. Coil L1, which is a type of coil-armature device, connects to and receives power from the power supply $V_{coil}$. Coil L1 also connects to first switch SW1 through a transistor Q1, which functions as a second type of switch. Wired in parallel with coil L1 is a freewheeling diode D1 that provides a path for the coil current generated by the charge stored in coil L1 to flow and dissipate whenever transistor Q1 is turned off.

The gate of Q1 communicates with switch SW1 through a resistance R4. The gate of Q1 also receives an output signal V4 from a first NAND logic gate G1 which functions as a controller for the transistor Q1. In response to voltage signal V4, transistor Q1 selectively turns on and off. Specifically, when voltage signal V4 is high, transistor Q1 turns on, thereby establishing a current path between power supply $V_{coil}$ and ground and allowing coil L1 to charge. When voltage signal V4 is low, transistor Q1 turns off, disrupting the current path between $V_{coil}$ and ground, causing coil L1 to discharge through the path established by diode D1.

If the coil driving circuit 10 is being utilized with very large size coils and high levels of current, the output signal V4 from NAND gate G1 can first be fed into a gate driver, such as, for example, a metal oxide semiconductor field effect transistor (MOSFET) driver that is capable of working with high voltage and current levels. However, for applications that utilize more traditional size coils, such as, for example, those used in a 42 volt, 40 amp relay, then a gate driver is not necessary and output voltage V4 can be directly fed to the gate of transistor Q1 through a direct connection, i.e., by directly connecting point A to point B in FIG. 1.

A second path between the power supply $V_{coil}$ and ground (through switch SW1) is established through a resistance R2 connected in series with a capacitor C4. The voltage V6 across capacitor C4 is provided as a first input voltage for the NAND gate G1. The second input voltage for NAND gate G1 is derived from the output of a pulse width modulation (PWM) signal generator 12 capable of delivering a PWM signal with a programmable duty cycle.

In the embodiment illustrated in FIG. 1, pulse width modulation (PWM) signal generator 12 includes a second NAND gate G2 that is configured as an inverter by connecting the first and second inputs of NAND gate G2 together, thereby creating one common input. A feedback loop is established by wiring a resistance R1 between the output of gate G2 and the common input of gate G2. The common input of NAND gate G2 is also connected to ground (by means of switch SW1) through a resistance R3 and capacitance C1 wired in parallel to one another.

Operation of the coil driving circuit 10, as illustrated in FIG. 1, will now be discussed in detail. Coil driving circuit 10 is activated upon closing switch SW1, thereby connecting the circuit 10 to ground. Upon activation of circuit 10, the input voltage V12 for NAND gate G2 is low as the charge across capacitance C1 has yet been allowed to build up. Due to the low input voltage V12, NAND gate G2 generates a high output voltage V35. The presence of a high output voltage V35 leads to the charging of capacitance C1 through the feedback loop of resistance R1. The charge across capacitance C1 increases until voltage V12 reaches the upper threshold voltage of NAND gate G2. Upon voltage V12 reaching this upper threshold voltage, the operating state of NAND gate G2 changes, such that gate G2 begins to generate a low output voltage V35. As a result of voltage V35 dropping to a low value, capacitance C1 begins to discharge through resistance R1 and R3. The charge across C1 continues to diminish until voltage V12 reaches a lower threshold voltage of NAND gate G2, resulting in the above process repeating itself, with gate G2 once again generating a high output voltage V35. In this manner, NAND gate G2, capacitance C1 and resistances R1 and R3 work together to generate a pulse width modulation (PWM) signal that oscillates between a high and low voltage level, such as $V_{coil}$ and ground, with an oscillation frequency determined by the time constant R1C1 and a duty cycle determined by the value of resistance R3.

Pulse width modulation (PWM) signal V35 is provided as one of the input voltages for NAND gate G1. NAND gate G1, however, is not initially influenced by the PWM signal V35. Instead, upon activation of the coil driving circuit 10, NAND gate G1 automatically generates a high voltage output signal V4 for a predetermined duration. This is because the other input voltage for NAND gate G1, specifically, voltage V6, is initially low due to the fact that a charge across capacitance C4 has yet been allowed to build up. As long as input voltage V6 remains low, and thus below an upper threshold voltage of gate G1, output voltage V4 will remain high regardless of the logic level of V35.

Upon activation of coil driving circuit 10, capacitance C4 begins to accumulate charge obtained from power supply $V_{coil}$ through resistance R2. Consequently, input voltage V6 gradually increases until it reaches the upper threshold voltage established by NAND gate G1. Once voltage V6 reaches this threshold, NAND gate G1 becomes responsive to the pulse width modulation (PWM) signal V35 that it receives as a second input voltage. As a result, when PWM signal V35 is high, output voltage V4 will be low, and when PWM signal V35 is low, output voltage V4 will be high.

Accordingly, NAND gate G1 is seen to operate in two different modes, including a "pull-in" mode and a "hold" mode. When coil driving circuit 10 is first activated, NAND gate G1 enters the "pull-in" mode, generating a high voltage output signal V4 for a predetermined duration. This high voltage output signal V4 turns on transistor Q1 for a predetermined duration, allowing the current flowing through coil L1 to ramp up to a sufficiently high level capable of generating a strong enough electromagnetic field to retract, or pull in, the armature.

Upon the input voltage V6 increasing to the threshold voltage, NAND gate G1 enters the "hold" mode, wherein the output signal of the gate, voltage V4, becomes responsive to the pulse width modulation (PWM) signal V35. Specifically, voltage V4 mimics the PWM signal V35 in a direct but opposite manner, such that when voltage V35 is low, voltage V4 is high, and when voltage V35 is high, voltage V4 is low. Consequently, transistor Q1 becomes responsive to the PWM signal V35, cycling on and off at a rate corresponding to the oscillation frequency of the PWM signal V35. The cycling on and off of transistor Q1 leads to the current flowing through coil L1 to ramp up and down, thereby charging coil L1 to a power level that is sufficient to retain or hold in place the already retracted armature, but lower in value than the initial power level required to cause retraction of the armature.

The duration of the "pull-in" mode of NAND gate G1 is determined by the rate at which voltage V6 is allowed to increase, which, in turn, is determined by the time constant R2C4. Accordingly, the duration of the "pull-in" mode can be controlled by adjusting the sizes of resistance R2 or capacitance C4.

According to the embodiment illustrated in FIG. 1, pulse width modulation (PWM) signal generator 12 comprises a NAND gate G2 configured as an inverter, along with capacitance C1 and resistances R1 and R3. However, according to one or more alternative embodiments of the present invention, coil driving circuit 10 can be adapted to accommodate essentially any type of circuit configuration, or electronic device, capable of generating a pulse width modulation signal that can be delivered as an input signal for NAND gate G1.

A second exemplary embodiment of the invention will now be discussed with reference to the circuit diagram illustrated in FIG. 2. Similar to the previous embodiment, coil driving circuit 20 electrically communicates with power supply $V_{coil}$, as well as with ground through a first switch SW1. Coil L1, representing a type of coil-armature device, connects in series with a transistor switch Q2, which selectively connects coil L1 to power supply $V_{coil}$. Connected in series between coil L1 and switch SW1 is a "current sense" resistance R18, which allows for the monitoring of the amount of current flowing between power supply $V_{coil}$ and ground, and thus through coil L1, when switch SW1 is closed. Wired in parallel with the series of coil L1 and resistance R18 is diode D2, thereby creating a loop path along which the current generated by coil L1 can flow and dissipate whenever transistor Q2 is off.

Control of transistor Q2 is the responsibility of comparator P1, whose output signal V3 is transmitted through a resistance R15 to the gate of transistor Q2. In response to voltage signal V3, transistor Q2 selectively turns on and off. Specifically, transistor Q2 is configured to turn on when V3 is low, thereby establishing a current path between power supply $V_{coil}$ and ground (assuming switch SW1 is closed) and allowing coil L1 to charge. When voltage signal V3 is high, transistor Q2 turns off, disrupting the current path between $V_{coil}$ and ground, causing coil L1 to discharge through the path established by resistance R18 and diode D2.

If the coil driving circuit 20 is being utilized with very large size coils and high levels of current, the output signal V3 from comparator P1 can first be fed into a gate driver, such as, for example, a metal oxide semiconductor field effect transistor (MOSFET) driver that is capable of working with high voltage and current levels. Optional protection for the relay driver can also be provided by connecting a zener diode Z1 and resistance R5 in parallel between power supply $V_{coil}$ and the gate of transistor Q2, thereby limiting the amount of voltage and current that can be passed from the power supply $V_{coil}$ to the gate driver during the occurrence of a fault.

Comparator P1 is configured to generate either a low or high voltage output signal V3 depending on the relationship between a first input signal V1 and a reference input signal Vref1. Specifically, when V1 is less than Vref1, then output signal V3 is low, but when V1 exceeds Vref1, then output signal V3 is high. Comparator P1 is also configured to exhibit a hysteresis-type of characteristic, establishing a different threshold level when the input voltage V1 is decreasing, eventually dropping below a threshold voltage that triggers the comparator P1 to reverse the output signal V3 back to a low value. This introduction of a hysteresis-type of action in comparator P1 is accomplished by the presence of resistances R9 and R11, both of which connect at one end to the first input of comparator P1 that receives input voltage V1. The other end of resistance R11 connects to the output of comparator P1, subsequent to resistance R15, while resistance R9 runs down to the point where coil L1 connects to resistance R18.

According to the present embodiment, input voltage V1 is a representation of the amount of current flowing through coil L1. Specifically, the voltage drop across resistance R18 is an indication of the amount of current flowing through coil L1. This voltage across resistance R18 is fed through resistance R9 to comparator P1, with the resultant voltage becoming the input voltage V1 of the comparator P1.

The voltage to which input signal V1 is compared to is the reference voltage Vref1. Voltage Vref1 is established by a voltage divider circuit, which, in the present embodiment, comprises zener diode Z2, a bi-directional analog switch U2, and resistances R6, R7, R8 and R10. The zener diode Z2 establishes a constant voltage across the series of resistances R7, R8 and R10, with the voltage across each of the resistances correlating to their resistance value. When coil driving circuit 20 is first activated by the closing of switch SW1, analog switch U2 is in an open state such that point C and point D of the switch U2 do not electrically communicate with one another. In this case, all three resistances R7, R8 and R10 remain in series with one another, with voltage Vref1 being equal to the voltage drop across the latter two resistances R8 and R10. After a predetermined duration of time, bi-directional analog switch U2 closes, leading to the establishment of a short between points C and D at switch U2. This effectively shorts out resistance R8 and results in voltage Vref1 becoming equal to the voltage drop across resistance R10 only.

The shorting of resistance R8 through closing of switch U2 is dependent upon a control signal V7 that is provided to the switch U2 by a second comparator P2. When coil driving circuit 20 is first activated, control signal V7 is in a low voltage state. It is only after circuit 20 has been activated for a predetermined period of time that comparator P2 begins to generate a high voltage output signal V7, thereby triggering switch U2 to close and resistance R8 to short out.

Figure 2:
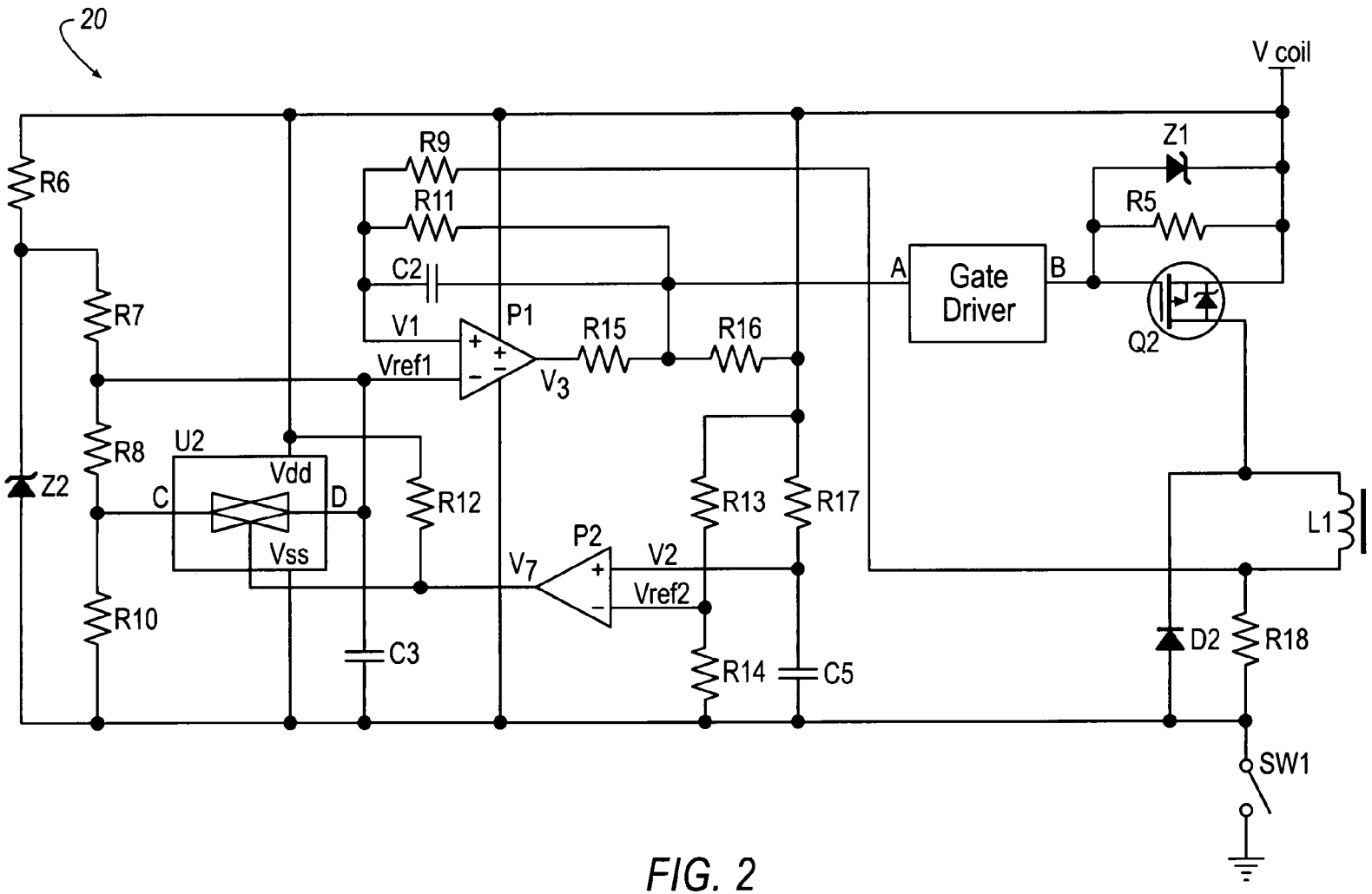
FIG. 2 is a circuit diagram of a coil driving circuit according to a second embodiment of the present invention.

Operation of the coil driving circuit 20, as illustrated in FIG. 2, will now be discussed in greater detail. Coil driving circuit 20 is activated upon closing of switch SW1, thereby connecting the circuit 20 to ground. Upon activation, circuit 20 first enters a "pull-in" mode, wherein coil L1 repetitively ramps up and down at a high current level, thereby charging coil L1 to a first power level that is sufficient to retract an armature back into the coil. At the initial moment of activation of circuit 20, both comparator input voltages V1 and V2 are in a low voltage state, V1 being low as no substantial amount of current has yet passed through the coil L1, and V2 being low as capacitance C5 has not had sufficient enough time to build up a charge. Consequently, voltage V2 is less than reference voltage Vref2, which is established as a fixed voltage drop across resistance R14 whenever circuit 20 is activated. As a result of V2 being less than Vref2, output signal V7 remains in a low state, thereby keeping switch U2 open and voltage Vref1 equivalent to the accumulated voltage drop across resistors R8 and R10.

With input voltage V1 being lower in value than voltage Vref1, comparator P1 generates a low voltage output signal V3 that is provided to the gate of transistor Q2. Transistor Q2 is configured to turn on in response to receiving a low gate voltage signal, and turn off in response to receiving a high gate voltage signal. Accordingly, transistor Q2 turns on in response to the low voltage signal V3, thereby allowing current to flow through the coil L1. As current continues to build or ramp up in value in coil L1, the voltage drop across resistance R18 increases. This increase in voltage across resistance R18 leads voltage V1 to increase in value. This buildup of voltage V1 continues until voltage V1 exceeds voltage Vref1. At this point, comparator P1 begins to generate a high voltage level output signal V3, which results in transistor Q2 turning off, thereby cutting off coil L1 from the power supply $V_{coil}$. Coil L1, having been allowed to ramp up to a relatively high power level, now begins to discharge as current, generated by coil L1, begins to dissipate as it traverses around the loop comprising resistance R18, diode D2 and coil L1. The stored energy in the coil L1 continues to dissipate, leading to a decrease in the voltage across resistance R18, and, subsequently, a decrease in voltage V1. Upon voltage V1 decreasing in value below voltage Vref1, comparator P1 returns to generating a low voltage output signal V3, which, in turn, turns transistor Q1 back on.

The above cycle repeats a plurality of times, causing coil L1 to ramp up and down at a high current level that provides a sufficient amount of power to retract an armature. During this time, capacitor C5 continues to build up charge, thereby causing voltage V2 to increase. Upon voltage level V2 exceeding the fixed voltage Vref2, comparator P2 begins to generate a high voltage level output signal V7. Upon receiving a high voltage level signal V7, analog switch U2 closes, thereby shorting out resistance R8. As a consequence of resistance R8 being effectively eliminated from the voltage divider, reference voltage Vref1 decreases in value. Specifically, before closure of switch U2, reference voltage Vref1 was equivalent to the total voltage drop across resistances R8 and R10. Upon closure of switch U2, thereby shorting resistance R8, reference voltage Vref1 decreases in value, now being equivalent to the voltage drop just across resistance R10.

The reduction in magnitude of reference voltage Vref1 signals that coil driving circuit 20 has transitioned from the earlier "pull-in" mode to a "hold" mode, wherein coil L1 is limited to charging to a second, lower power level that is insufficient to retract an armature, but sufficient to maintain, or "hold" in place, an armature that has already been retracted. Specifically, coil driving circuit 20 continues to repetitively turn transistor Q2 on and off in response to voltage signal V3 oscillating back and forth between a high and low voltage. The duration in which voltage signal V3 remains in either a high voltage state or a low voltage state is dependent on the magnitude of reference voltage Vref1. The greater the magnitude of Vref1, the longer it takes for voltage V1 to either increase to the value of Vref1, or decrease from the value of Vref1 to a lower threshold voltage. Consequently, when reference voltage Vref1 is greater in magnitude, transistor Q2 remains on for longer periods of time, allowing coil L1 to ramp up at a higher current level then when Vref1 is smaller in magnitude, as is the case during the "hold" mode of circuit 20. When reference voltage Vref1 is decreased in magnitude, transistor Q2 can remain on for only shorter periods of time, thereby limiting the current level to which coil L1 can ramp up to.

Accordingly, the second embodiment of the invention, as presented above, calls for a coil driving circuit 20 that initially drives coil L1 according to a first duty cycle that permits the coil current to ramp up and down at a high current level. This allows the coil L1 to be charged to a first power level that is sufficient to retract an armature. After a predetermined duration of time, coil driving circuit 20 drives coil L1 according to a second duty cycle that permits the coil current to ramp up and down at a more limited current level. This limits the charging of coil L1 to a second, lower power level that is insufficient to retract an armature, but sufficient to maintain the position of an armature that has already been retracted.

While the invention has been specifically described in connection with certain specific embodiments thereof, it is to be understood that this is by way of illustration and not of limitation, and the scope of the appended claims should be construed as broadly as the prior art will permit.

What is claimed is:

1. A circuit for driving a coil-armature device, comprising:

a first switch configured to selectively activate the circuit;

a second switch, responsive to a control signal, that causes a driving voltage source to periodically energize the coil-armature device according to one of a first duty cycle and a second duty cycle;

a voltage divider comprising a plurality of resistors; and an analog switch, responsive to a change mode signal, that causes a transition from said first duty cycle to said second duty cycle through the selective shorting of at least one of the plurality or resistors in the voltage divider.

2. The circuit according to claim 1, wherein said second switch is a transistor.

3. The circuit according to claim 1, wherein:

said second switch is configured to periodically energize the coil-armature device according to said first duty cycle for a determined period of time sufficient to move the armature to a center of the coil, and said second switch is configured to periodically energize the coil-armature device according to said second duty cycle subsequent to said period of time sufficient to move the armature to the center of the coil.

4. The circuit according to claim 1, further comprising a first comparator configured to generate said control signal in response to a comparison between the voltage signal indicative of an amount of energy stored in said coil-armature device and a first reference signal.

5. The circuit of claim 4, wherein said voltage signal indicative of an amount of energy stored in said coil-armature device is generated across a resistor connected in series with the coil-armature device.

6. The circuit of claim 4, wherein:

said first reference signal has a first voltage level during a time period sufficient to move the armature to a center of the coil, and said first reference signal has a second voltage level subsequent to said time period sufficient to move the armature to the center of the coil.

7. The circuit of claim 4, wherein said first reference signal is generated from the voltage divider circuit.

8. The circuit of claim 7, wherein said voltage divider circuit is adjustable so as to be able to change said first reference signal in response to a said circuit mode signal.

9. The circuit of claim 7, further comprising a second comparator that compares a second input signal to a second reference signal to generate said circuit mode signal.

10. The circuit of claim 9, wherein said second input signal is generated based on a voltage level across a capacitor.

11. The circuit of claim 10, wherein said capacitor is sized so that said second input signal exceeds said second reference signal after a determined time sufficient to move the armature to a center of the coil has elapsed.

12. The circuit of claim 9, wherein said second input signal is configured to exceed said second reference signal after a determined time sufficient to move the armature to a center of the coil has elapsed.

13. The circuit according to claim 4, further comprising a relay positioned between said first comparator and said second switch.

14. The circuit according to claim 4, further comprising a feedback capacitor connected in parallel to said first comparator and configured to prevent the interference of random oscillations generated by the operation of said first comparator.

15. A circuit for driving a coil-armature device, comprising:

a first switch configured to selectively activate the circuit;

a second switch, responsive to a control signal, that causes a driving voltage source to periodically energize the coil-armature device according to one of a first duty cycle and a second duty cycle;

an analog switch, responsive to a change mode signal, that causes a transition from said first duty cycle to said second duty cycle; and a first comparator configured to generate said control signal in response to a comparison between a voltage signal indicative of an amount of energy stored in said coil-armature device and a first reference signal;

wherein said first reference signal is generated from a voltage divider circuit;

wherein said voltage divider comprises a plurality of resistors; and wherein at least one of the resistors is configured to be electrically shorted from said voltage divider in response to the closure of said analog switch.

* * * * *